US006766907B2

(12) United States Patent
Jackson

(10) Patent No.: US 6,766,907 B2
(45) Date of Patent: Jul. 27, 2004

(54) CASE WITH RELEASABLY ATTACHED HOUSING

(76) Inventor: Ellen R. Jackson, 1476 Moraga Dr., Los Angeles, CA (US) 90049

( * ) Notice: Subject to any disclaimer, the term of this patent is extended or adjusted under 35 U.S.C. 154(b) by 169 days.

(21) Appl. No.: 10/185,666

(22) Filed: Jun. 27, 2002

(65) Prior Publication Data

US 2003/0015455 A1 Jan. 23, 2003

Related U.S. Application Data

(63) Continuation-in-part of application No. 09/796,288, filed on Feb. 28, 2001, now Pat. No. 6,631,806.

(51) Int. Cl.[7] ..... B65D 81/02

(52) U.S. Cl. ..... 206/581; 206/459.1; 206/457

(58) Field of Search ..... 206/581, 823, 206/459.1, 457, 223; D9/311, 341; 446/391, 100; 132/200, 286, 293, 294, 301, 314, 315, 316, 317, 319; 434/84, 98, 100, 103

(56) References Cited

U.S. PATENT DOCUMENTS

| | | | | |
|---|---|---|---|---|
| 659,802 | A | | 10/1900 | Rohlfs |
| D91,003 | S | | 11/1933 | Younghusband |
| D91,835 | S | | 3/1934 | Martin |
| 2,234,739 | A | | 3/1941 | Murrell |
| D145,811 | S | | 10/1946 | Linduska |
| D163,569 | S | | 6/1951 | Christy |
| D210,055 | S | | 1/1968 | Walker |
| 3,718,260 | A | | 2/1973 | Sharp |
| 4,221,060 | A | | 9/1980 | Moskowitz et al. |
| 4,421,127 | A | | 12/1983 | Geer |
| 4,596,528 | A | | 6/1986 | Lewis et al. |
| 4,600,592 | A | | 7/1986 | Dobis |
| 4,685,558 | A | | 8/1987 | Filiz et al. |
| 4,890,741 | A | | 1/1990 | Edelstein |
| 5,005,697 | A | | 4/1991 | Jimbo et al. |
| 5,067,618 | A | | 11/1991 | Johnson |
| D339,883 | S | | 9/1993 | Madar |
| 5,246,020 | A | | 9/1993 | Wu |
| 5,433,643 | A | | 7/1995 | Pratt |
| 5,498,189 | A | | 3/1996 | Townsend |
| 5,769,234 | A | | 6/1998 | Gueret |
| D400,702 | S | * | 11/1998 | McEvoy Sherman ..... D3/205 |
| 5,897,322 | A | | 4/1999 | Shteyngarts |
| 5,897,416 | A | | 4/1999 | Barrows |
| 5,915,729 | A | | 6/1999 | Vap |
| 6,059,122 | A | | 5/2000 | Cartmell |
| 6,164,451 | A | | 12/2000 | Sherman |
| D455,005 | S | * | 4/2002 | Wolf ..... D3/205 |
| D457,301 | S | * | 5/2002 | DeVries et al. ..... D3/205 |
| 6,481,577 | B1 | * | 11/2002 | Roegner ..... 206/581 |
| 6,631,806 | B2 | * | 10/2003 | Jackson ..... 206/581 |
| D482,162 | S | * | 11/2003 | Bostroem ..... D28/77 |

* cited by examiner

*Primary Examiner*—Shian T. Luong
(74) *Attorney, Agent, or Firm*—Charles Berman, Esq.; Greenberg Traurig, LLP

(57) ABSTRACT

An apparatus and method for displaying and packaging cosmetic items. The display case apparatus for cosmetics and other personal care products comprises a housing having an overall shape defining a peripheral edge; a retainer defining a plurality of interstices, said retainer coupled to said housing such that it is co-extensive with at least a portion of the housing peripheral edge, said retainer having a front whereupon a design is visible whereas the plurality of interstices are disposed at pre-determined portions of the design; at least one holding compartment disposed within at least one retainer interstice for receiving an article. The method comprises the steps of providing a design corresponding to a human body portion having predetermined colors, the design defining interstices at locations in the design corresponding to predetermined body part segments and disposing within the interstices cosmetic and personal care containers of a pre-determined color or shape complimentary with the pre-determined body part segment.

18 Claims, 9 Drawing Sheets

CASE WITH RELEASABLY ATTACHED HOUSING

CROSS-REFERENCE TO RELATED APPLICATIONS

This application is a continuation-in-part of U.S. patent application Ser. No. 09/796,288, filed Feb. 28, 2001, now U.S. Pat. No. 6,631,806, entitled "COSMETIC PACKAGING DEVICE", which is herein incorporated by reference in its entirety.

BACKGROUND OF THE INVENTION

1. Field of the Invention

The invention pertains to the field of cosmetic containers and more particularly display devices which show application of cosmetic products.

2. General Background and State of the Art

Display of some personal care products and cosmetics often require the viewer to take an imaginative leap in visualizing, let alone fixating, what the particular product displayed would look like as applied to their own face or body. Applying sample products is not always available or convenient, and sampling a number of products at one sitting may prove difficult. Store displays, purchasing aids, and advertisements may illustrate cosmetic colors, but the question of how these colors may combine with a user's facial tones or how they may appear in combination with other cosmetics is usually left to the purchaser's imagination. Moreover, manipulable aids such as color wheels and the like may be nearly overwhelming in their presentation of so many colors and nonetheless operate in a context that makes it difficult to visualize their actual color and effect on the wearer. Cosmetics are unique in that their optimal use may usually rely on contrasting colors on a particular foundation where the ultimate colors and tone of which are heavily dependent on the user's complexion and other facial features for its effect. Some apparatus and/or method of reproducing this effect for a potential wearer without having to "try-on" numerous cosmetic compounds would find significant use.

This application uses the wording "Cosmetic Products" or "Cosmetics" broadly to encompass, without limitation, beautifying, enhancing, cleansing, covering and/or medicinal compounds which may be applied to a wearer's body, or portion thereof, especially those exhibiting a particular ornamental color, shade or tone on the wearer. "Facial Design" is likewise used broadly in this application to encompass a body portion of a human which may derive benefit from use of cosmetics and which may illustrate particular colors, tones and complexions, was well as features exemplified by facial elements such as nose, eyes, lips and cheeks, but by no means so limited to such features.

INVENTION SUMMARY

What is disclosed is an apparatus and method for displaying and packaging cosmetic items. The display case apparatus for cosmetics and other personal care products comprises a housing having an overall shape defining a peripheral edge; a retainer defining a plurality of interstices, said retainer coupled to said housing such that it is co-extensive with at least a portion of the housing peripheral edge, said retainer having a front whereupon a design is visible whereas the plurality of interstices are disposed at pre-determined portions of the design; at least one holding compartment disposed within at least one retainer interstice for receiving an article. The display case apparatus may also comprise a housing releasably attached/coupled to said display case, such that said housing is releasably attached and co-extensive with at least a portion of the display case apparatus. The method comprises the steps of providing a design corresponding to a human body portion having pre-determined colors, the design defining interstices at locations in the design corresponding to pre-determined body part segments and disposing within the interstices cosmetic and personal care containers of a pre-determined color or shade complimentary with the pre-determined body part segment.

DETAILED DESCRIPTION OF THE PREFERRED EMBODIMENTS

Figure 1B:
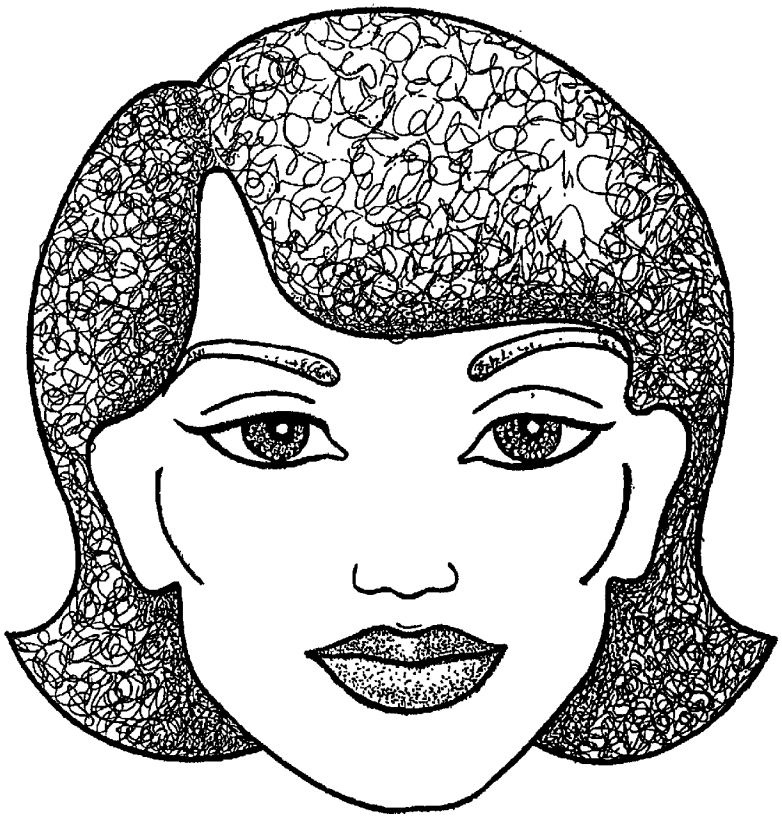
FIG. 1*b* illustrates a facial design exhibiting another complexion of an exemplary embodiment of the invention.
Figure 1A:
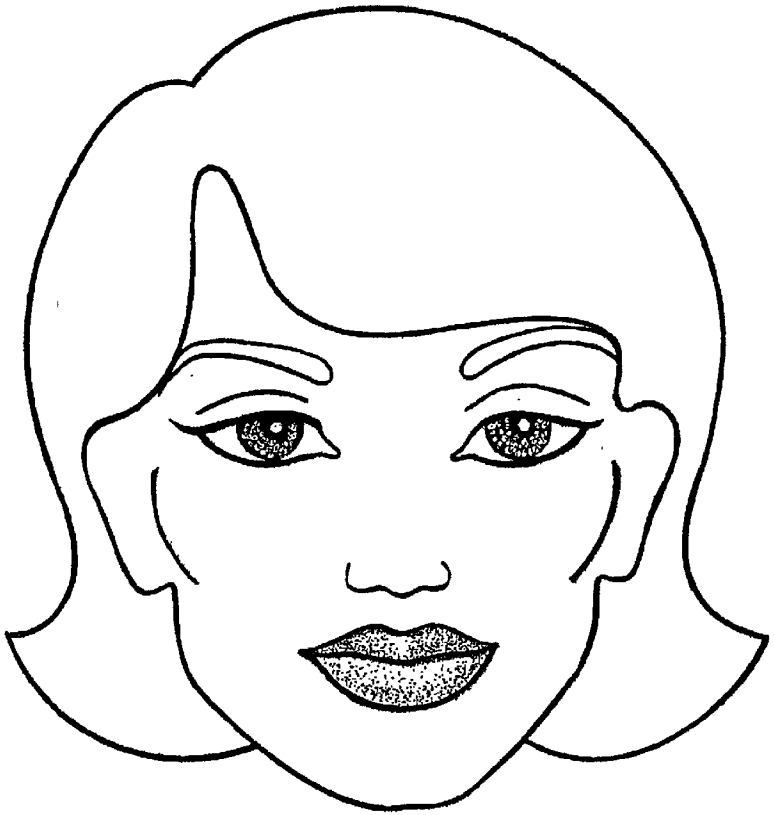
FIG. 1*a* illustrates a facial design exhibiting one complexion of an exemplary embodiment of the invention.
Figure 1D:
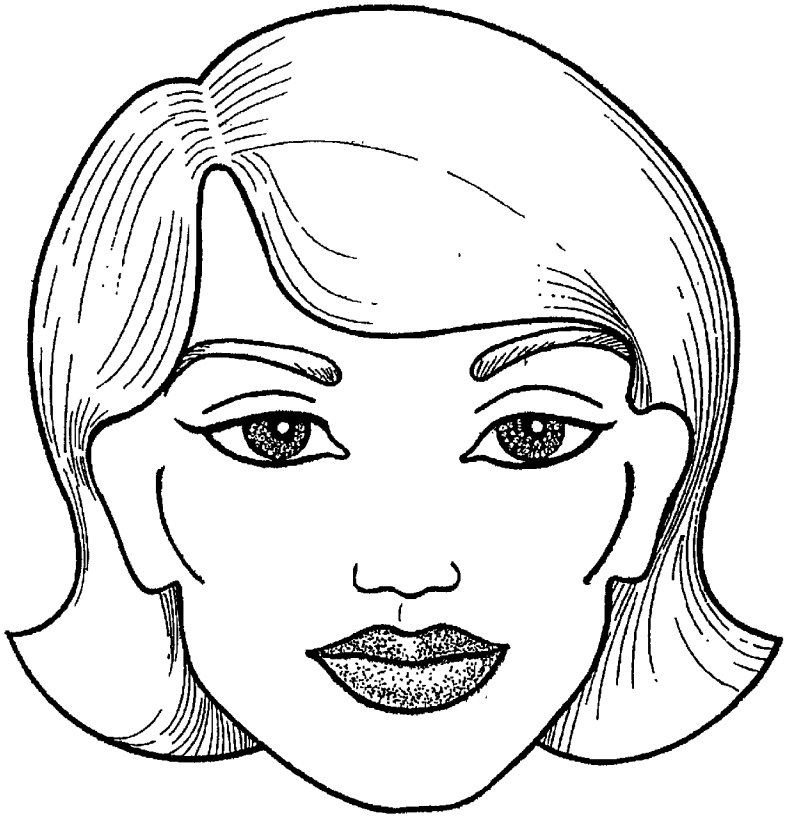
FIG. 1*d* illustrates a facial design exhibiting still another complexion of an exemplary embodiment of the invention.
Figure 1C:
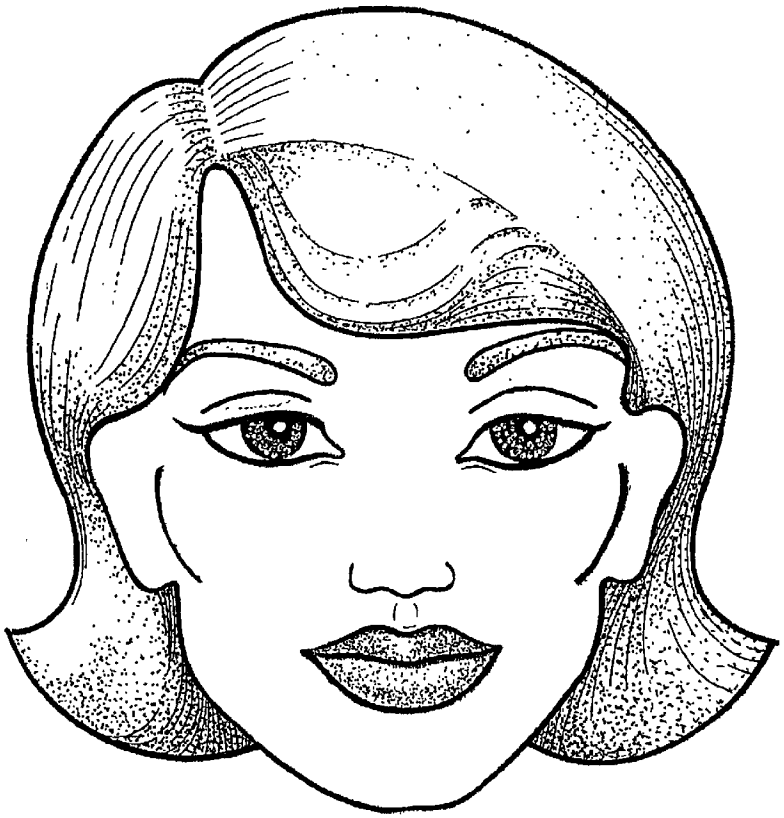
FIG. 1*c* illustrates a facial design exhibiting yet another complexion of an exemplary embodiment of the invention.

With respect to the figures provided, illustrating one embodiment of the invention, FIGS. 1*a*, 1*b* and 1*c* illustrate facial designs which are reproductions of various facial types, including complexion types, allowing a user to more clearly approach their own facial structure and complexion. These facial designs provide the basis for the display or packaging of various cosmetics, allowing these cosmetics to be viewed in relation to a particular complexion against which they may be compared and/or contrasted either alone or in various combinations. The facial designs feature facial types available that may be selected from a representative assortment or may be customized to an individual's particular facial structure and complexion. Preparation of such a facial design may be derived from a profile, whether generic or customized, based on a photograph, digitized image, artist's rendering, or any combination thereof or in other ways of graphic reproduction known in the art. The drawings illustrate use of artist renderings.

FIG. 1*a* illustrates facial design with fair skinned, blond haired features; FIG. 1*b* a facial design with an ebony complexion with dark hair; FIG. 1*c* illustrates a facial design with a medium complexion and red hair; and FIG. 1*d* illustrates a brunette haired medium dark complexion facial design. It is to be appreciated that numerous variations and complexions may also be illustrated and/or customized in a facial design. The facial designs each exhibit sufficient surface area for skin, eyes, lips, eyebrow, hair, cheeks, ears and nose to also accommodate application of a cosmetic product that may be applied to each area. Other areas, such as neck, forehead, upper and lower eyelashes, eyelids and any other facial or body features may also be illustrated and similarly presented for the application of particular cosmetics. In the figures, an artists rendering of a face is illustrated, but, as stated previously, this may be any one of a combination of digitized image, photograph or otherwise. For instance, the facial design may be derived from a photograph which is retouched to elongate or distort facial features to provide sufficient space for the application of cosmetics or personal care products of varying styles and colors while maintaining the original complexion for purposes of comparison and demonstration. The artistic display possibilities and renderings for the facial design are therefore unlimited and may be prepared according to the methods known in the art.

The facial design is applied to a surface, which may be composed of various polymer plastics or other material retaining sufficient tensile strength to support integrated interstices wherein containers of cosmetics are disposed. This surface may be placed within a housing that basically comports to the overall shape of the surface. The surface upon which the design appears is either of sufficient durability and strength to retain and hold compartments defined within interstices in the surface into which will be received containers having reservoirs of cosmetics. Alternatively, the facial design may be applied to a surface within a housing over which a transparent retaining layer may be placed, where the design is visible through the retaining layer and the retaining layer otherwise has the properties of the surface previously described, i.e. strength and durability to receive reservoir containers into interstices defining compartments.

Figure 2:
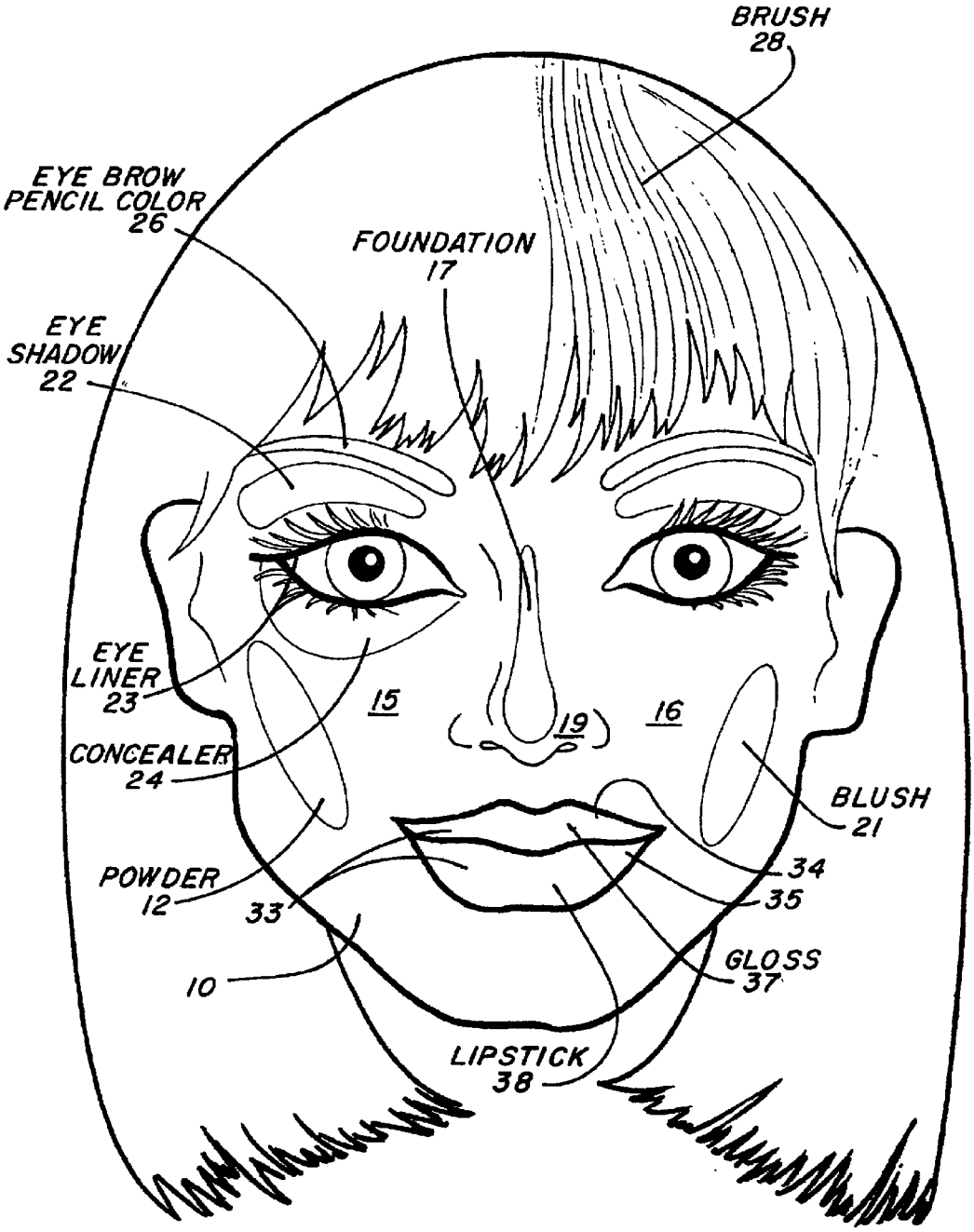
FIG. 2 illustrates a facial design exhibiting cosmetic compartments in one embodiment of the invention.

FIG. 2 illustrates a particular facial design 10 of one embodiment of the invention where a plurality of interstices (not pictured) are defined within the facial design surface, or within an intermediate transparent layer placed over the facial design surface, provide areas for cosmetic containers to be received, so as to provide a comparison or contrast with the overall complexion, hair color and/or facial features of the design, whether that design is of a specific individual or of a generic type. The cosmetics are thus held in place by a retainer comprising either the facial design surface or the intermediate transparent layer with an underlying facial design surface visible therethrough. Thus, powder 12 may be inserted in a corresponding powder interstice (not pictured) on cheek 15 to allow for the comparison of the powder color with the particular skin color 20. Blush 21 may be placed on the opposite cheek 16 from powder 12 to allow its view in isolation from other applications yet allowing a direct comparison to the overall complexion of the figure or any desired contrast from powder 12. Foundation 17 may be placed on nose 19 to highlight its use as close to the corresponding site of use for the face of a use. Similarly, interstices for shadow 22, eye liner 23, concealer 24, eye brow pencil color 26 and hair brush 28 may also be included, among other types of products that may be applied to the figure depicted.

Lips 33 may include interstices for an upper 34 and lower lip 35 segments. In one embodiment, this division of lip 33 interstice may provide openings for the placement of gloss 37 and lipstick 38. The gloss portion may already have a base lipstick color to heighten the visual effect of any gloss applied thereto. Actual containers (not pictured) of lipstick and lip gloss, as with other application products depicted on the face design, may occupy the lip 33 interstices, divided into segments 34 and 35, and may be freely removable therefrom, as will be further described in later figures, to allow demonstration and view of a number of different application products according to their colors and tones in comparison/contrast with the overall tone and complexion of the facial design 10.

Interstices may have shapes and sizes sufficient to manipulate and replace cosmetic containers therein. In the embodiment illustrated, the interstices (not pictured) have the size and shape of the simulated facial design features themselves. For instance, concealer 24 interstice and reservoir occupies the lower eye region at the point where concealer 24 would be utilized on a user's face. Similarly lips 33 interstices conform to the basic shape of human lips. The invention, however, is not limited to providing interstices, containers or reservoirs which are shaped according to the facial feature or element of the corresponding application product. For instance, the interstices for powder 14 may be small circular interstices within an area defined by powder 14 on facial design 10. Into these interstices may be received containers bearing the powder reservoir which may alternatively be open to allow the cosmetic powder to be accessed and applied, covered with a transparent cover to view the cosmetic powder, or covered with an opaque cover bearing a reproduction of the powder color within the container.

One or more interstices, moreover may be provided for powder at various portions of the facial design to allow the user to move the application to other areas for comparison/contrast with the overall complexion or color of the face, or to place separate colored powders in each interstice to compare and contrast the use of multiple color powders in combination on facial design 10. Similarly, shadow interstices need not be eye-shaped or semi-elliptical, but may be round, square, triangular or any other type of shape so long as the interstices accept a similarly shaped container or reservoir of the application product that will be placed within.

Figure 3:
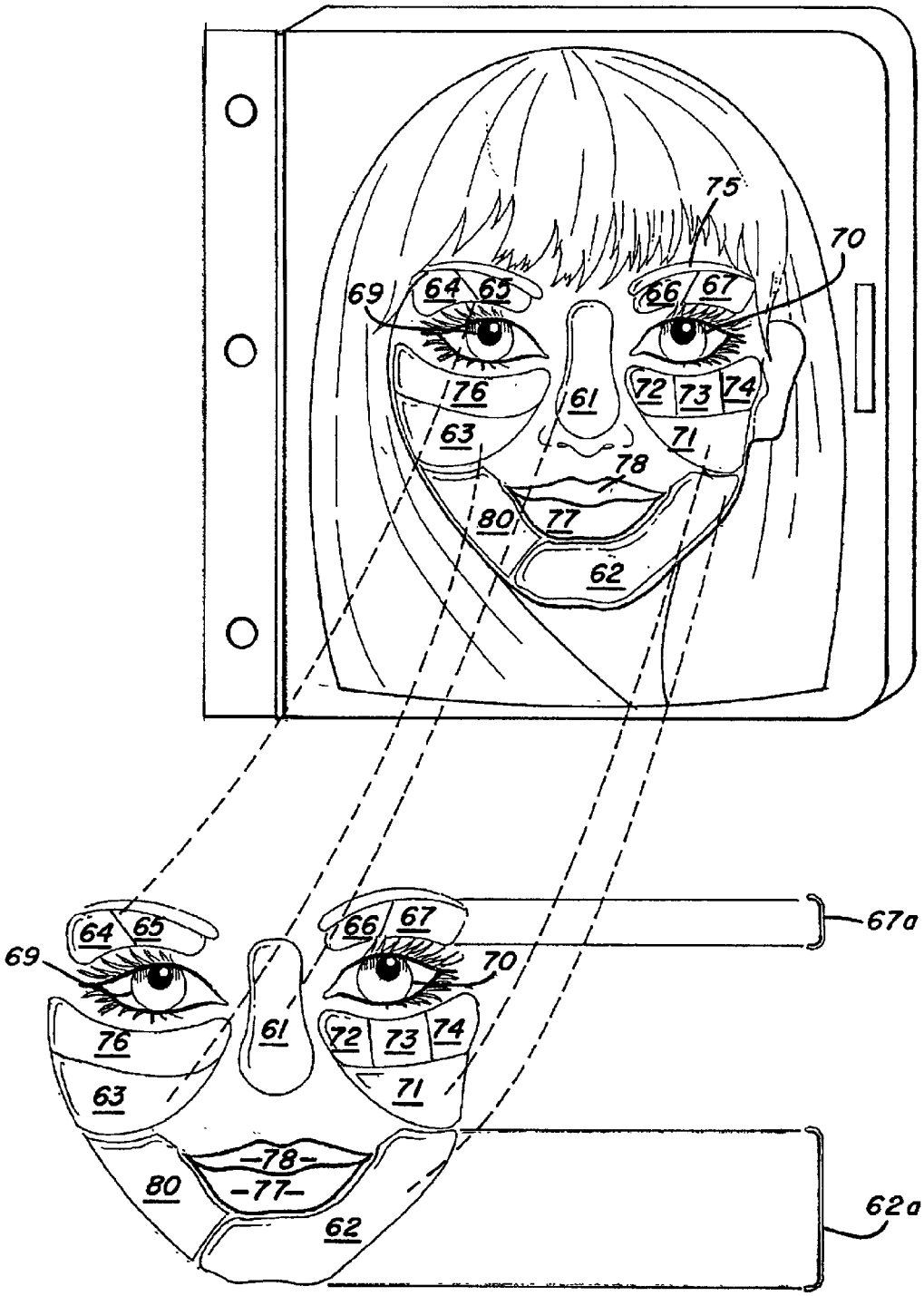
FIG. 3 illustrates an alternative embodiment of the invention indicating shapes and positions of cosmetic compartments in a facial design.

FIG. 3 illustrates one embodiment or the facial design as provided with containers for various cosmetics situated approximately at a facial element depicted on the facial design. In this embodiment, the location of the cosmetic containers pertain to interstices located at the depicted facial element that the particular cosmetic is likely to be applied by a user. For instance, foundation 61, occupies the nose section, and, in this embodiment, features a nose shaped container. Translucent face powder 62 occupies the lower facial design near the chin element. Various containers for different eye shadows 64–67 may be incorporated on the eyebrow location of the facial design. Other containers, 68–80, are similarly listed and situation on the facial design as shown in FIG. 3.

The containers themselves may be shaped in accordance with their location and use on the facial design. Hence, container 62*a* for the translucent face powder conforms to at least a portion of the shape of the facial element and fits in a corresponding size interstice located at that portion of the facial design. Container 62*a* has a depth for holding a pre-determined amount of cosmetic, in this instance translucent face powder. Similarly, container 67*a* for eye shadow also has a shape conforming to a portion of the corresponding facial element, in this case the eyebrow, and has a depth for holding a pre-determined amount of eye shadow. In this embodiment, containers 62*a* and 67*a* would generally have a bowl like shape for holding cosmetic products which may include a surrounding lip rim to rest on the facial design surface surrounding the interstice in which it would be received. Corresponding containers 68–80 for other facial elements would generally follow the same basic composition as those described for containers 62*a* and 67*a*, e.g. they would conform to the applicable interstice located at the particular facial element and the containers would have depths to hold an effective predetermined amount of cosmetic product.

Figure 4:
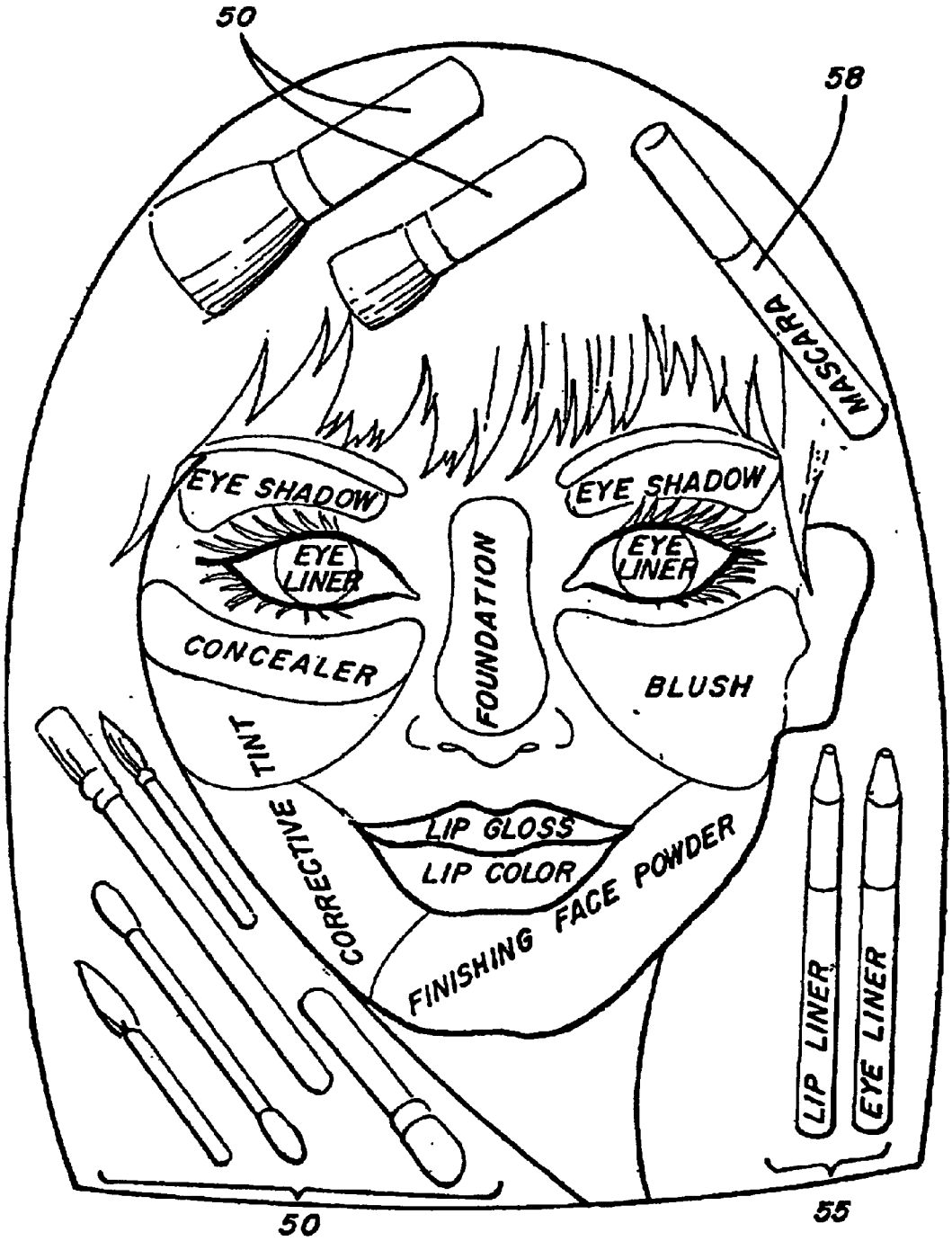
FIG. 4 illustrates an alternative embodiment of the invention featuring a facial design with surrounding cosmetic compartments.
Figure 5:
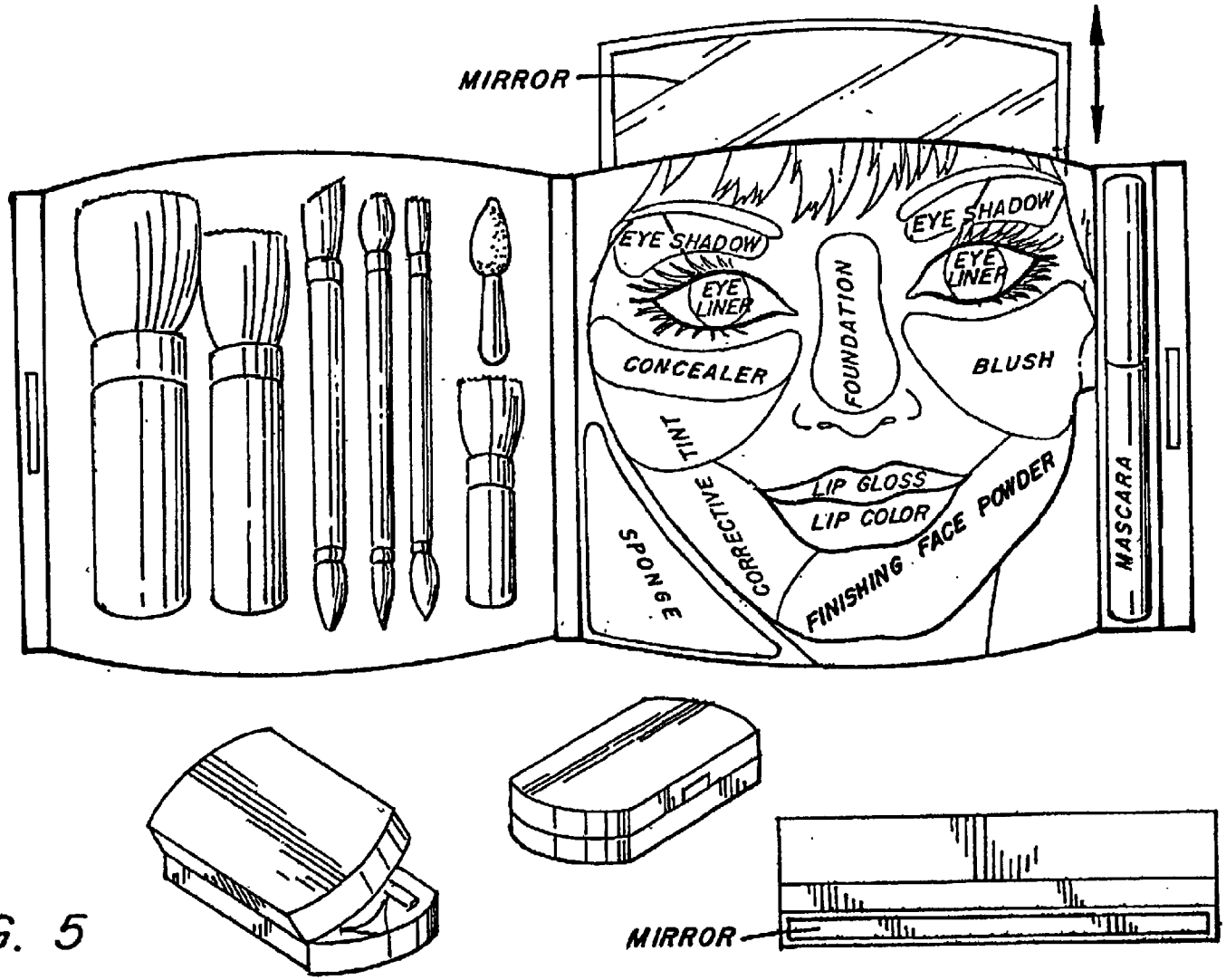
FIG. 5 illustrates an alternative embodiment of the invention featuring a facial design and cosmetic compartments contained within a travel case.

FIG. 4 illustrates yet another embodiment of the invention, wherein the interstices within the facial design are accompanied by other interstices wherein other cosmetic products and applicators may be disposed. For instance, brushes and applicators 50 of various sizes for various functions, as well as lip and eyeliner pencils 55 and mascara applicators 58 may be placed around the facial design to make up the overall package, along with the actual cosmetics to be applied disposed at the appropriate location, within interstices where holding compartments are disposed to hold any containers therefor, on the facial design. FIG. 5 illustrates an alternative embodiment, where the display is in compact form for travel. Brushes and applicators may be positioned on a cover opposite the facial design, which is folded over to cover the facial design to form a case when not in use.

Figure 6:
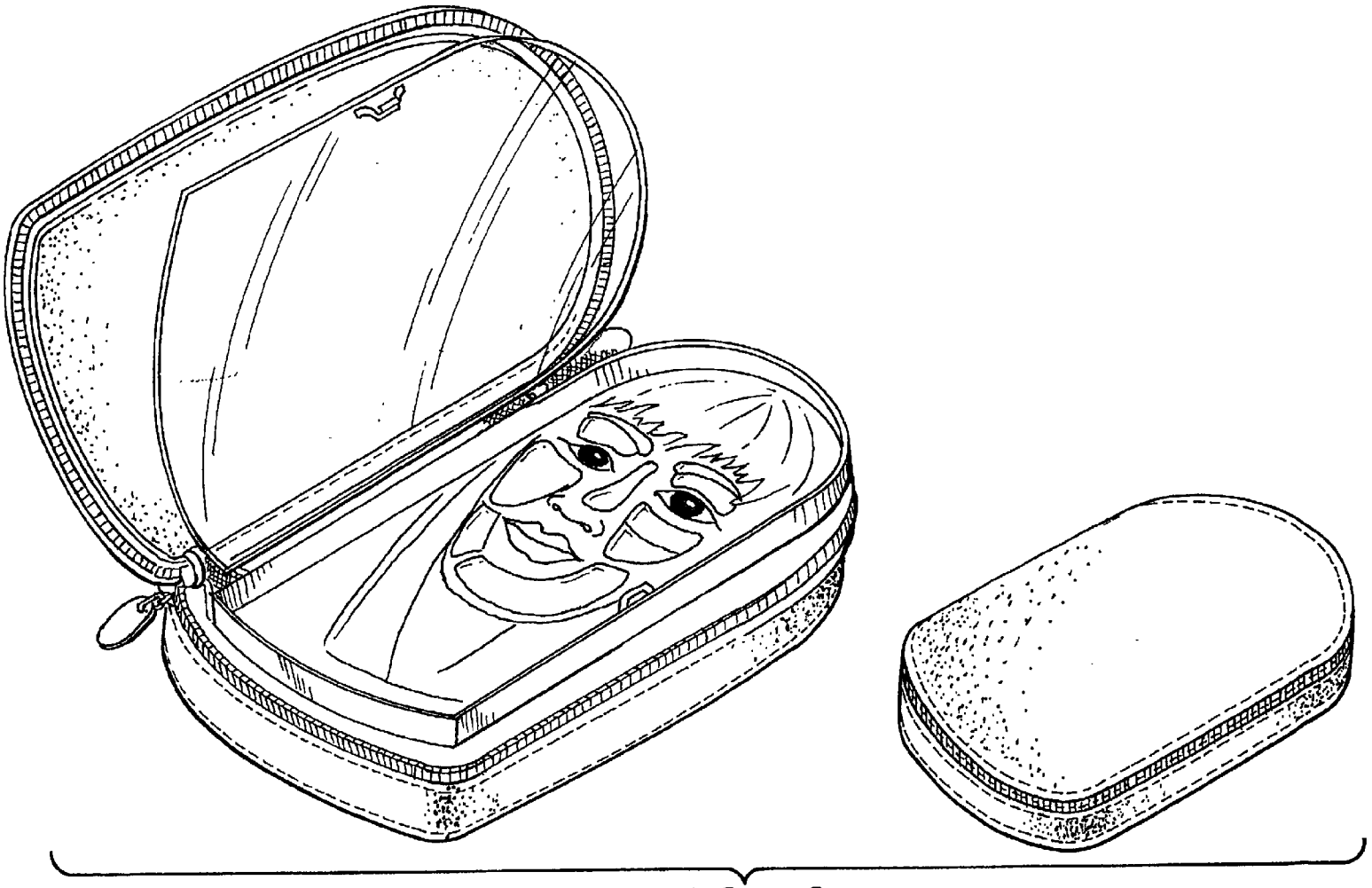
FIG. 6 illustrates one housing configuration of the invention.

FIG. 6 illustrates a possible configuration of one embodiment of the invention whereby the facial design and interstices are coordinated in a single unit case. Case 100 accommodates a transparent molded tray layer containing interstices (not pictured) for receiving and retaining cosmetic containers. On the case inner cover, disposed below the tray, is the facial design portrait which, when the tray is placed thereover, is visible through the tray. The interstices within the tray correspond to the particular location of the product, e.g. blush container over the cheeks, eyeliner container over the eyes, such that superimposing the cosmetic color, visible either as applied to an outer covering of the container or by viewing the actual cosmetic product itself (utilizing, for instance, a removable transparent plastic cover), over the facial design provides the point of comparison and contrast for the user with respect to each cosmetic product that may be interposed within the tray (as stated earlier, this embodiment may also allow for interchanging of cosmetic containers).

Figure 7:
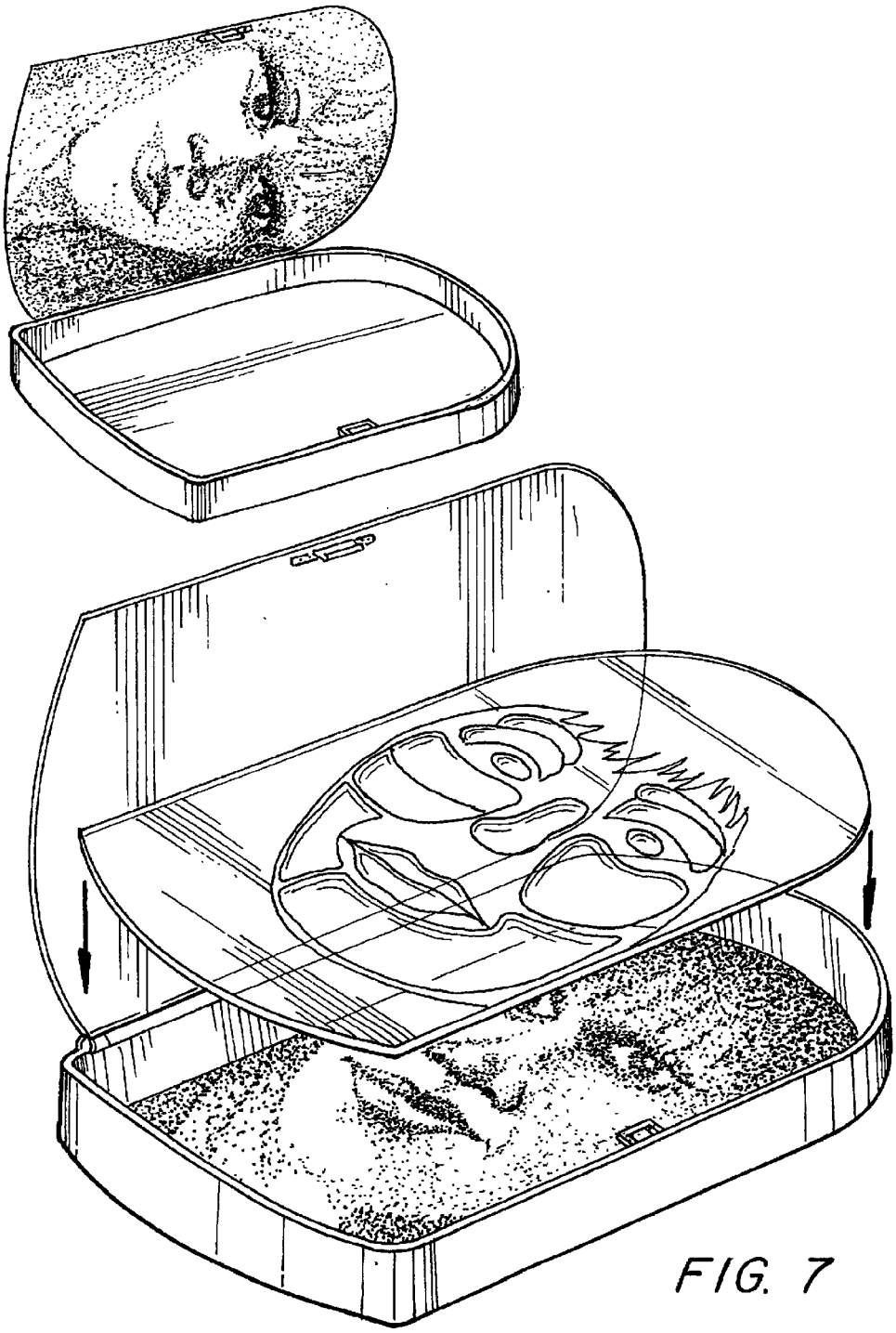
FIG. 7 illustrates and alternative housing configuration of the invention.

FIG. 7 illustrates an alternative configuration of one embodiment of the invention. Wherein the case accommodates a transparent retaining layer that includes magnets at the bottom of each interstice to receive and hold the containers, which may be either fully or partially made of metal to allow for magnetic attraction within the interstices. As with the embodiment in FIG. 6, the facial design appears below the transparent layer, so as to be visible to a viewer.

Figure 8:
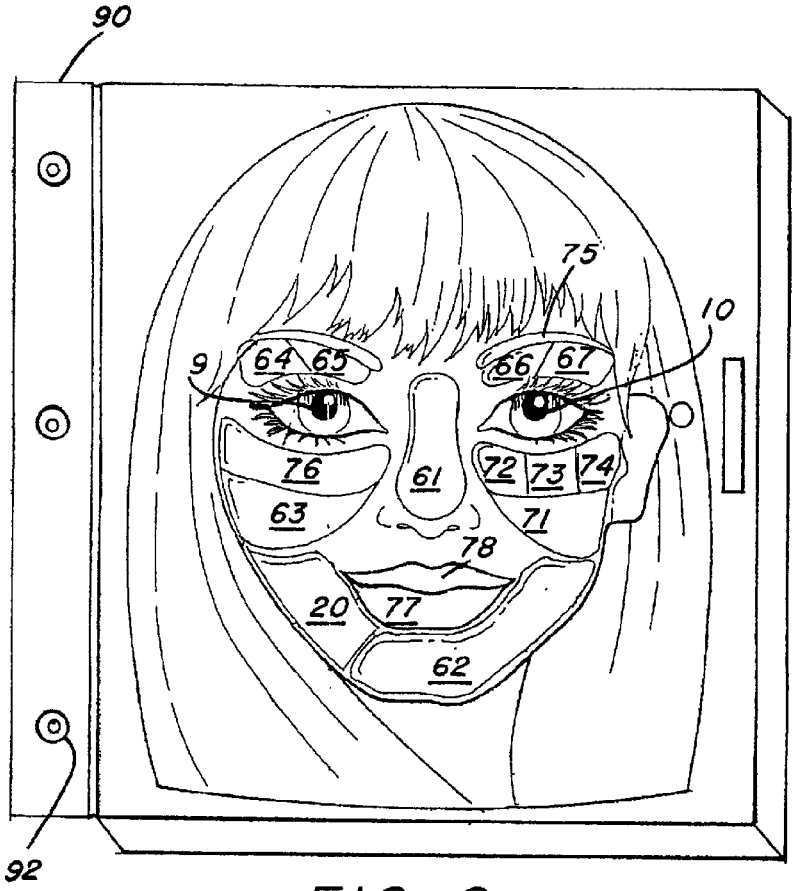
FIG. 8 illustrates an exemplary embodiment of the invention featuring a facial design exhibiting cosmetic compartments and exemplary releasable coupling means, according to the teachings of the present invention.

FIG. 8 illustrates one embodiment or the facial design as provided with containers for various cosmetics situated approximately at a facial element depicted on the facial design. In this embodiment, the location of the cosmetic containers also pertain to interstices located at the depicted facial element that the particular cosmetic is likely to be applied by a user, as in embodiments depicted in FIGS. 6 and 7. Here, the housing includes releasable coupling means for releasably coupling the housing to at least a portion of the case such that the housing is co-extensive with at least a portion of the case. This is similar to the attaching of various loose articles into a binder, for example. As a result, the housing is securely coupled to the case, yet may be easily removed and/or replaced, by a user, if so desired. As exemplarily depicted in FIG. 8, the housing may have an extended portion 90 which may facilitate releasably attaching the housing to the display case.

Figure 9:
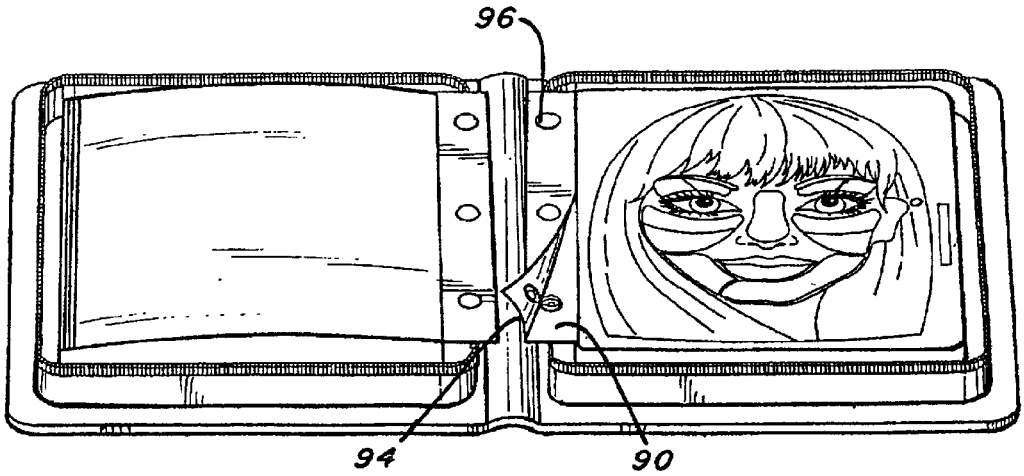
FIG. 9 illustrates an exemplary embodiment of the invention featuring a facial design exhibiting cosmetic compartments, being exemplarily releasably attached to at least a portion of the display case.

Various methods may be employed for releasably coupling the exemplary housing to the display case. One exemplary method employs snap buttons, as depicted in FIGS. 8 and 9. Here, the housing may comprise an extended portion 90 wherein a first component of the releasable coupling means, one portion of a snap button 92, for example, may be located. Accordingly, another component of the releasable coupling means, such as a second portion of a snap button 96, may be located on a portion of the housing, here depicted as an extension of the display case 94. A user then may releasably couple the housing to the display case. This provides a user interchangeability of various housings having various facial design portraits and/or a transparent molded tray layer containing interstices (not pictured) for receiving and retaining various combinations of cosmetic containers in the interstices.

Various exemplary releasable coupling means may be employed to releasably couple the housing to the display case. These include, but are not limited to, snap buttons, magnets (magnet/magnet or magnet to metal), pin and hole configurations, snap lip configurations, ring and hook type fabrics, ring and hole couplings (such as those seen in 3-ring binders, for example), zippers, buttons, grip seals (with and without slides), clamps, clasps, hinges, detachable hinges, snap fittings, buckles having various releases (side and center releases, for example), rings, hooks, clips and twists locks. Other means may comprise press buckles, snap hooks, clip locks, lobster hooks, glides, retaining elements and corresponding slots/rails (such as removable/detachable hinges), tuck buckles, clasps and other releasable coupling means, as known in the art.

While the invention has been described in respect to the above embodiments of the invention, it should be understood that the invention is not limited to these precise embodiments. Rather, many modifications and variations will present themselves to persons skilled in the art without departure from the scope and spirit of the inventions, which is defined in the appended claims.

While the specification describes particular embodiments of the present invention, those of ordinary skill can devise variations of the present invention without departing from the inventive concept.

We claim:

1. A display case apparatus for cosmetics and other personal care products comprising:

a housing defining at least one peripheral edge the housing including at least one component of a releasable coupling for releasably coupling the housing to at least a portion of the display case such that the housing is co-extensive with at least a portion of the display case, the display case defining at least one peripheral edge;

a retainer defining a plurality of interstices, said retainer coupled to said housing such that it is co-extensive with at least a portion of the housing peripheral edge, said retainer having a front whereupon a predetermined design is displayed, whereas the pluralities of interstices are disposed at positions corresponding to predetermined portions of the design;

at least one holding compartment disposed within at least one retainer interstice for receiving an article; and wherein the design displayed on the retainer front is a human face design, the interstices are disposed on the surface of the face, and the articles to be received in the compartments are containers of at least one of cosmetics or personal care articles.

2. The display case apparatus of claim 1, wherein the human face design has a predetermined color or shade scheme.

3. The display case apparatus or claim 2, wherein the containers further comprise a transparent cover allowing the color or shade of the cosmetic and/or personal care articles to be visible to a viewer.

4. The display case apparatus of claim 3, wherein the cosmetics or personal care articles disposed within the containers have a color complementary to the face design shade or color scheme.

5. The display case apparatus of claim 1 wherein the containers are of a shape conforming to specific contours of the holding compartments.

6. The display case apparatus of claim 5 wherein containers of a pre-determined shape are interchangeably disposable within the corresponding holding compartment.

7. The display case apparatus of claim 6 wherein the shape of the containers corresponds to the particular class of cosmetics or personal care articles contained.

8. The display case apparatus of claim 1 further comprising attachment means disposed within the holding compartments for releaseably coupling containers within the holding compartments.

9. A method for displaying at least one of cosmetics or personal care articles comprising the steps of:

providing a design corresponding to a human body portion having predetermined colors, the design defining interstices at locations in the design corresponding to pre-determined body part segments;

disposing within the interstices cosmetic and personal care containers of a predetermined color or shade complimentary with the pre-determined body part segment; and attaching said design to a housing, the housing comprising a releasable coupling for the housing to a case.

10. The method of claim 9 further comprising alternatively placing and removing containers within the body part segment interstices of differing pre-determined colors or shade.

11. The method of claim 9 wherein the human body portion is a facial design.

12. A display case apparatus for cosmetics and other personal care products comprising:

a housing having an inner surface on which a predetermined design is displayed, said housing including a releasable coupling to secure the housing to said display case;

a optically transparent retainer defining a plurality of interstices, said retainer coupled to said housing overlaying said housing inner surface such that the surface predetermined design is visible through said retainer and whereas the plurality or interstices are disposed at portions corresponding to pre-determined portions of the design;

at least one holding compartment disposed within at least one retainer interstice for receiving an article; and the pre-determined design displayed housing inner surface being a human face design and the pre-determined positions corresponding to portions of the face, and the articles to be received in the compartments are containers of at least one of cosmetics or personal care articles.

13. The display case apparatus of 12, further comprising containers disposed within ax least one holding compartment.

14. The display case apparatus of claim 12 wherein the containers have a plurality of segmented compartments each to receive a pre-determined cosmetic product.

15. The display case apparatus of claim 12 further comprising attachment means disposed within the holding compartments for releasably coupling containers within the holding compartments.

16. The display case apparatus of claim 12 wherein containers of a pre-determined shape are interchangeably disposable within the corresponding holding compartment.

17. The display case apparatus of claim 12 wherein the shape of the containers corresponds to the particular class of cosmetics or personal care articles.

18. A display case apparatus for cosmetics and other personal care products comprising:

a housing having an inner surface on which a predetermined design is displayed, said housing including a releasable coupling to secure the housing to said display case;

a optically transparent retainer defining a plurality of interstices, said retainer coupled to said housing overlaying said housing inner surface such that the surface predetermined design is visible through said retainer and whereas the plurality or interstices are disposed at portions corresponding to pre-determined portions of the design;

at least one holding compartment disposed within at least one retainer interstice for receiving an article; and the housing inner surface being a first inner surface and the housing having a second inner surface having a mirror occupying at least apart of the second inner surface.

* * * * *